US005988057A

United States Patent [19]

Salomon et al.

[11] Patent Number: 5,988,057

[45] Date of Patent: Nov. 23, 1999

[54] POSTAL CANCELLATION MACHINE

[75] Inventors: James A Salomon, Cheshire; Anthony E. Yap, Danbury, both of Conn.

[73] Assignee: Pitney Bowes Inc., Stamford, Conn.

[21] Appl. No.: 08/943,405

[22] Filed: Oct. 3, 1997

[51] Int. Cl.[6] ..... B41L 47/46

[52] U.S. Cl. ..... 101/91; 400/120.09; 209/578

[58] Field of Search ..... 101/91, 2; 400/120.09; 209/584, 578, 592, 594, 587; 380/55; 705/408, 410

[56] References Cited

U.S. PATENT DOCUMENTS

| | | | |
|---|---|---|---|
| 2,887,951 | 5/1959 | Strother et al. . | |
| 2,976,803 | 3/1961 | Van Marle . | |
| 2,988,984 | 6/1961 | Eckert, Jr. et al. . | |
| 3,373,685 | 3/1968 | Adams | 101/2 |
| 3,938,435 | 2/1976 | Suda et al. | 101/2 |
| 4,511,793 | 4/1985 | Racanelli | 101/91 |
| 4,520,932 | 6/1985 | Matsuda et al. | 209/578 |
| 4,998,626 | 3/1991 | Ota | 209/584 |
| 5,061,100 | 10/1991 | Brouwer et al. . | |
| 5,308,932 | 5/1994 | Manduley et al. . | |
| 5,322,977 | 6/1994 | Manduley et al. . | |
| 5,440,979 | 8/1995 | Bonham et al. . | |
| 5,611,630 | 3/1997 | Dolan et al. | 400/120.09 |
| 5,730,049 | 3/1998 | Broschart | 101/91 |
| 5,734,723 | 3/1998 | Windel et al. | 380/55 |
| 5,799,290 | 8/1998 | Dolan et al. | 705/410 |
| 5,819,241 | 10/1998 | Reiter | 705/408 |

*Primary Examiner*—Eugene Eickholt
*Attorney, Agent, or Firm*—Steven J. Shapiro; Melvin J. Scolnick

[57] ABSTRACT

An apparatus for canceling postage on individual mailpieces of a stack of mixed mail includes an apparatus for separating individual mailpieces from the stack of mixed mail; structure for feeding the separated individual mailpieces along a feed path; a mechanism, positioned along the feed path, for detecting the presence of stamps on individual mailpieces; a printing mechanism having a plurality of digital printheads; a control, in communication with the detecting mechanism, for operating the printing mechanism to print a cancellation mark over stamps on individual mailpieces in response to detection by the detecting mechanism of the presence of stamps on individual mailpieces; and apparatus for determining the number of rows of stamps on individual mailpieces and for selectively energizing only the individual ones of the plurality of digital printheads needed to ensure that the cancellation mark is printed over each of the sensed number of rows of stamps on individual mailpieces. A method is associated with the apparatus.

13 Claims, 5 Drawing Sheets

POSTAL CANCELLATION MACHINE

BACKGROUND OF THE INVENTION

Postage cancellation machines, such as the one described in the U.S. Pat. No. 3,027,830, have been utilized for many years by postal authorities to print a cancellation mark on top of stamps attached to mailpieces. Typically, the cancellation mark is applied by bringing an inked cancellation die into contact with the stamps. The ink cancellation mark provides a visual indication that the stamps have already been used to pay for postage and thus cannot be used again on a subsequent mailpiece. In operation, the cancellation machine utilizes photoelectric scanning devices to detect postage stamps having phosphorescent material or fluorescent material incorporated therein. That is, the photoelectric scanning devices illuminate the luminescent material in the stamp so that, in turn, the luminescent material emits light back to the photoelectric scanning devices. The presence of stamps is indicated if the photoelectric scanning devices sense the light emitted by the stamp. If a stamp is detected, the mailpiece is transported to the cancellation die where the cancellation mark is applied in a known manner.

In prior art cancellation machines however, the ability to automatically separate, transport, and cancel stamps on individual pieces of mail from a stack of "mixed mail" could not effectively be accomplished. The term "mixed mail" is used herein to mean sets of intermixed mailpieces of varying size (postcards to 9" by 12" flats), thickness, and weight. In addition, the term "mixed mail" also includes stepped mail (i.e. an envelope containing therein an insert which is smaller than the envelope to create a step in the envelope), tab and untabbed mail products, and mailpieces made from different substrates. It was found that when attempting to automatically process sets of mixed mail through the cancellation machine, the mail often stalled in transport or double pieces of mail were transported together instead of individual mailpieces. Thus, it was not possible to effectively and reliably separate the individual pieces of mail on a consistent basis in order to ensure that a cancellation mark was placed on each individual mailpiece. Accordingly, it was typical to process stacks of the same size of mailpieces through the cancellation machine and to print the cancellation mark on these same size mailpieces. Naturally, to cancel mail in this manner required a great deal of human intervention since the incoming mailpieces had to be sorted by size and stacked in the cancellation machine for processing with other mailpieces of the same size.

SUMMARY OF THE INVENTION

In view of the above disadvantages of existing cancellation machines, it is an object of the invention to provide a cancellation machine which is capable of receiving a stack of mixed mail and which can separate each of the individual pieces of the stack of mixed mail and detect and cancel the stamps on each of the individual mailpieces. Yet another object is to provide a cancellation machine having increased functionality as compared to prior art machines.

The above objects are met by providing an apparatus for canceling postage on individual mailpieces of a stack of mixed mail includes an apparatus for separating individual mailpieces from the stack of mixed mail; structure for feeding the separated individual mailpieces along a feed path; a mechanism, positioned along the feed path, for detecting the presence of stamps on individual mailpieces; a printing mechanism; a control, in communication with the detecting means, for operating the printing mechanism to print a cancellation mark over stamps on individual mailpieces in response to detection by the detecting mechanism of the presence of stamps on individual mailpieces. A method is associated with the apparatus.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENTS

Figure 1:
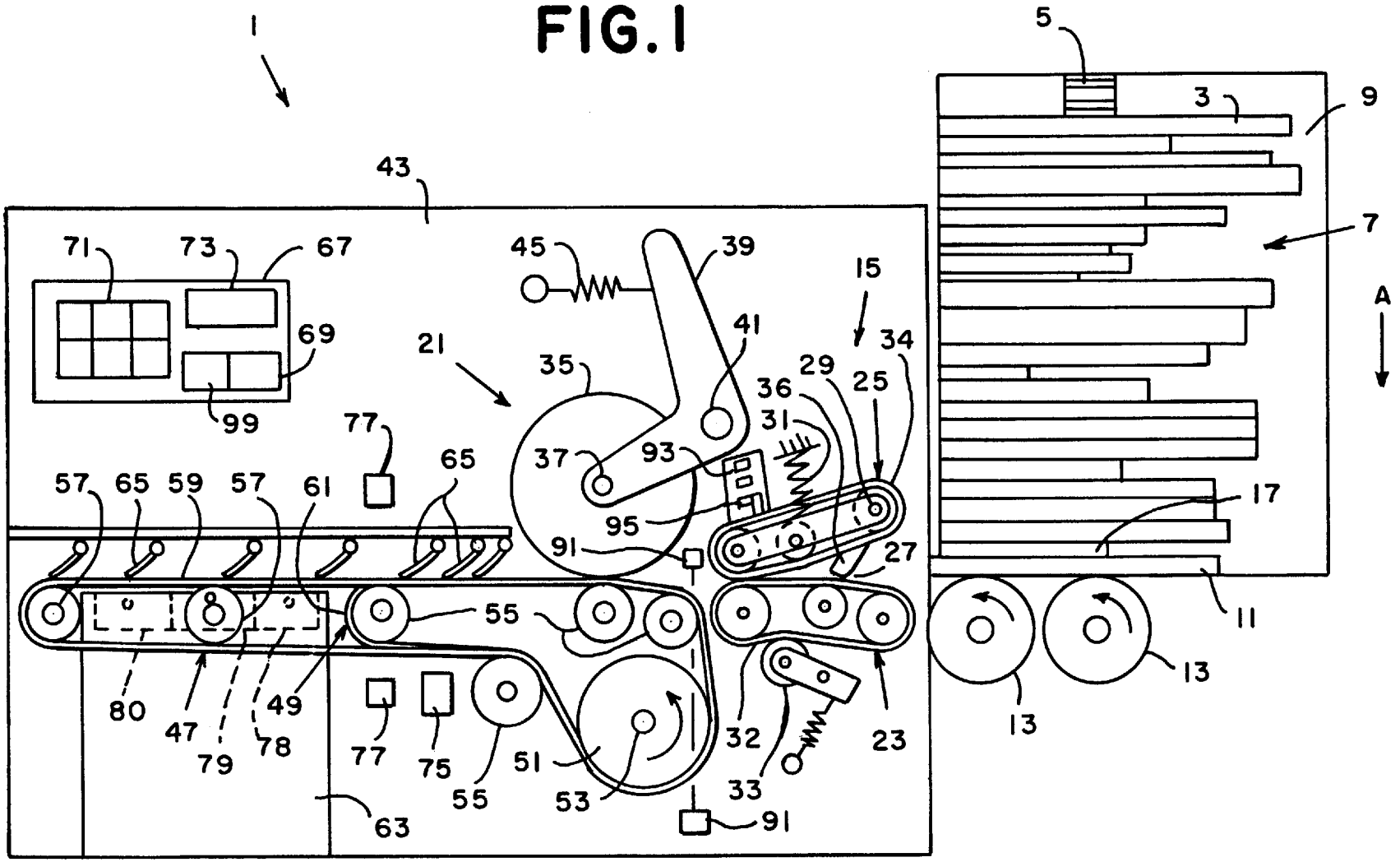
FIG. 1 is a plan view of the inventive cancellation machine.

Referring to FIG. 1, the inventive mixed mail cancellation machine is shown at 1. The mixed mail cancellation machine 1 includes a stack advance mechanism consisting of a paddle 3 connected to a driven continuous belt 5. The belt 5 moves in the direction of Arrow "A" taking the paddle 3 therewith. A stack of mixed mailpieces 7 rests against paddle 3 and on top of a deck 9. The individual mailpieces of the stack 7 are placed to stand on edge such that as the paddle 3 moves in the direction "A" the entire stack of mail 7 is also forced to move in that same direction. The lead mailpiece 11 is forced by the advancing paddle 3 into contact with four nudger rollers 13 that are each driven into rotation in the counterclockwise direction of FIG. 1. When the lead mailpiece 11 contacts the driven nudger rollers 13, they feed the lead mailpiece 11 away from stack 7 and toward a singulating apparatus 15. It is important to note that as the nudger rollers 13 continue to feed the lead mailpiece 11 toward the singulating apparatus 15, the next mailpiece 17 is also fed toward singulating apparatus 15. However, at this point in time, typically the first and second mailpieces 11, 17 are in an overlapped (shingled) relationship with respect to each other. The singulating apparatus 15 then separates the lead mailpiece 11 from the next mailpiece 17 so that only individual mailpieces leave the singulating device 15 for transport downstream by a take away transport structure 21 which is described in more detail below.

Singulating apparatus 15 includes a feed belt assembly 23 and a reverse belt assembly 25 which define a nip 27 therebetween into which the mailpieces from the stack of mixed mail 7 are fed by the nudger rollers 13. The feed belt assembly 23 is fixed in place to provide a registration surface for the individual mailpieces while the reverse belt assembly 25 is free to rotate about a fixed shaft 29 to accommodate the varying thickness of mailpieces entering nip 27. The reverse belt assembly 25 is biased toward the feed belt assembly 23 by a spring 31. Moreover, tension on the individual belts of feed belt assembly 23 is maintained by a plurality of corresponding tensioning rollers 33. The feed belt assembly 23 includes three feed belts 32, while the reverse belt assembly 25 includes two reverse belts 34. Moreover, spring loaded fingers 36 assist with the ingestion of the mailpiece into nip 17. Further details of the stack advance mechanism, the nudger rollers 13, and the singulating apparatus 15 are fully described in two applications entitled A NUDGER FOR A MAIL HANDLING SYSTEM and A SINGULATING APPARATUS FOR A MAIL HANDLING MACHINE, each of which are being concurrently filed with the instant application under respective Attorney Docket Numbers E-661 and E-662 and both of which are hereby incorporated by reference. However, it is to be noted that the above discussed components act together to ensure that each individual mailpiece is ultimately separated from the stack 7 and fed individually out of the singulating apparatus 15 to the take away transport structure 21.

Transport structure 21 includes a pair of large idler rollers 35 mounted for free rotation about a shaft 37 fixedly disposed in lever bracket 39. Lever bracket 39 is pivotably mounted on a shaft 41 extending from feed deck 43. The take away rollers 35 are biased toward the feed path of the mailpieces by a spring 45 fixedly connected to deck 43. Directly opposite each of the take away rollers 35 are respective belt transport assemblies 47 and 49. Each of the belt transport assemblies 47/49 include a driven pulley 51 which is driven by a motor (not shown) connected to a common shaft 53 on which each driven pulley 51 is fixedly mounted. Each belt transport assembly 47, 49 further includes a plurality of idler pulleys 55. Belt transport assembly 47 further includes two additional idler pulleys 57. A first continuous belt 59 is disposed around a first driven pulley 51 and each of the corresponding idler pulleys 55 and 57. A second continuous belt 61 is disposed around another one of the driven pulleys 51 and each of its correpsonding idler pulleys 55. As noted in FIG. 2, the length of the belt 61 is less than the length of belt 59 in order to permit the print head 63 to print a cancellation mark on the stamps of each of the individual mailpieces, as will be discussed in more detail below. The additional idler pulleys 57 are required by the top belt transport assembly to effectively transport individual mailpieces through the full extent of belt 59 and past printhead 63.

Directly opposing each of the belts 59, 61 are a series of spring loaded skis 65. The individual mailpieces leave singulating apparatus 15, are ingested into the nip between the take away rollers 35 and each of the belts 59, 61, and transported downstream toward the printing mechanism 63. As the mailpiece is transported from the take away rollers 35 it is ingested between each of the skis 65 and the belts 59, 61 for continued transport downstream toward the printing mechanism 63. At the point where the first belt 61 ends, only skis 65 associated with the top second belt 59 are utilized to transport the mailpiece past the printing mechanism 63. As the individual mailpiece is transported past the printing mechanism 63 a cancellation mark is printed over each of the stamps in a manner to be described in more detail below.

Mounted on feed deck 43 is a control panel 67. Control Panel 67 includes a microprocessor 69, a keyboard 71, and a display 73. Microprocessor 69 controls the operation of the cancellation machine 1 while keyboard 71 and display 73 permit communication between the microprocessor 69 and an operator of cancellation machine 1.

A pair of photoelectric scanning devices 75/76 are positioned along the mailpiece feed path for the purpose of detecting if stamps are present on each individual mailpiece being processed. For example, lead mailpiece 11 has a plurality of stamps 77 attached thereon. As mailpiece 11 is transported past the scanning devices 75/76, the stamps 77 are illuminated by the scanning devices 75/76. The presence of stamps is detected by the scanning devices 75/76 detecting the illuminated light that the stamps emit back. Microprocessor 61 receives signals from sensors 75/76 indicative that the mailpiece 11 has stamps 77 thereon. Subsequently, when the lead edge of mailpiece 11 is detected by a conventional through-beam sensor 77, microprocessor 69 controls the energizing of three ink jet printheads 78, 79 and 80 in a known manner to print a cancellation mark across the stamps 77 as they are transported thereby. Alternatively, if the sensors 75/76 do not detect the presence of a stamp 77, microprocessor 69 does not cause the printheads 78, 79 and 80 to print the cancellation mark, but operates a diverter (not shown) positioned downstream from the printing mechanism 63 to divert these mailpieces to a separate bin for subsequent special processing.

The use of two sensors 75/76 are shown for the purpose of associating each row of stamps 81, 83 with a corresponding one of the sensors 75/76. That is, different sizes of mailpieces will typically have one or two rows of stamps placed thereon. For example, a common letter sized envelope would only have a single row of stamps while a large 9" by 12" flat would typically have two rows of stamps. By associating each sensor 75/76 with a respective one of the rows of stamps 81/83, information is sent from the sensors 75/76 to microprocessor 69 indicative of the number of rows of stamps. Based on this information, microprocessor 69 can selectively energize only the required number of printheads 78, 79, 80 needed to print a cancellation mark over the particular number of rows of stamps sensed. This reduces the amount of ink consumed as compared to always printing a cancellation mark large enough to cover the maximum anticipated number of rows of stamps that could be present on any individual mailpiece in the stack of mixed mail 7.

Figure 2:
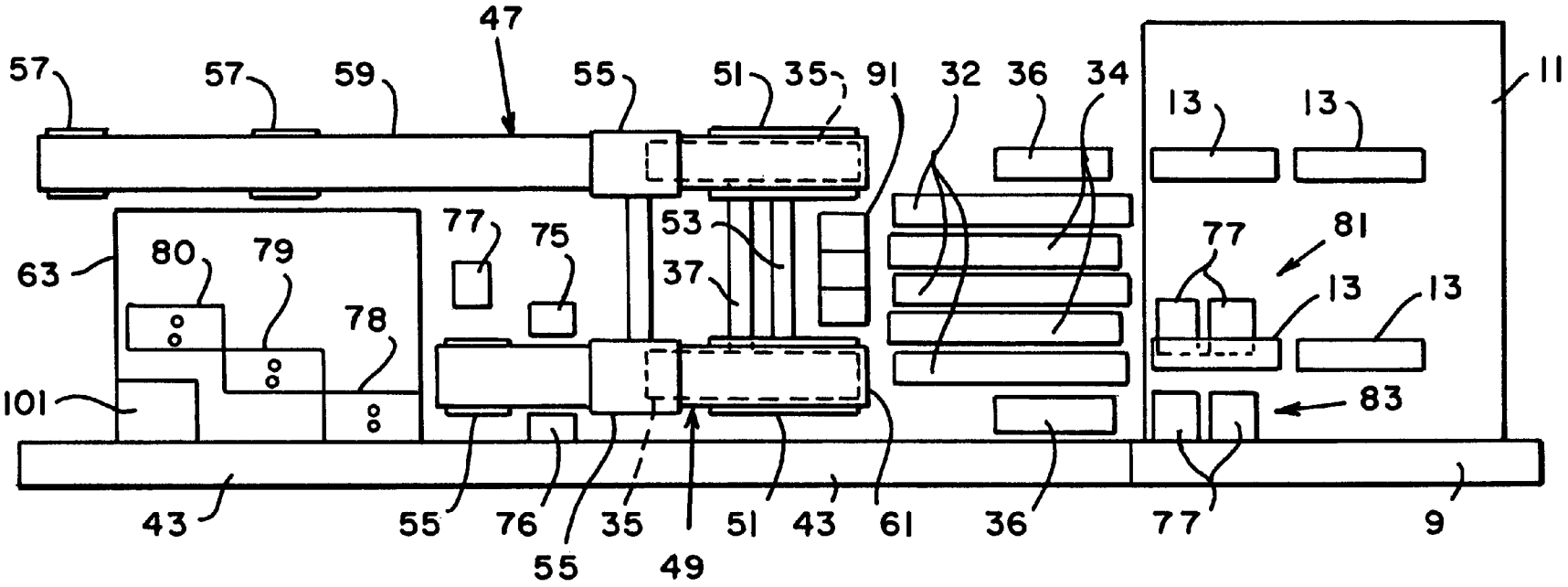
FIG. 2 is a side view of FIG. 1.

FIG. 2 shows a sample cancellation mark that can be applied to a mailpiece "M" in the inventive apparatus. As noted, mailpiece "M" has two rows of stamps 85, 87. Thus, when the sensors 75, 76 respectively detect each row of stamps 85, 87, each of the printheads 78, 79, 80 will be energized to print a respective cancellation mark 88, 89, 90. Cancellation marks 88, 89 effectively cancel the first row of stamps 87 while cancellation mark 90 effectively cancels the bottom row of stamps 85. In the preferred embodiment, cancellation marks 88, 89 would always be printed since the incoming stack of mixed mail 7 has the individual mailpieces positioned upside down on edge with the stamps facing the nudger rollers 13. That is, since the upper right hand corner of the mailpiece is the typical required position to attach stamps, both small and large size mailpieces having stamps will trigger the bottom sensor 76. However, normally, only large mailpieces will require two rows of stamps such that if the top sensor 75 does not detect a second row of stamps, the cancellation mark 90 will not be printed.

It is important to note that while the above described embodiment requires the mailpieces to be positioned as discussed above relative to the sensors 75, 76, the machine could be set up to print cancellation marks on either side of the mailpiece by providing a printing mechanism 63 and sensors 75/76 on both sides of the mailpiece feed path. This drives up the cost of the machine and still requires that the mailpieces be positioned on the stack advance feed deck 9 with their top edge down.

While the description above discussed the use of the sensors 75/76 to determine which of the cancellation marks 88, 89, 90 to print, alternatively a bank of through beam sensors 91 could be utilized for the same purpose. That is, since the number of rows of stamps on a mailpiece is typically related to its size, the bank of sensors 91 can be utilized to determine whether the height of the mailpiece 11 is greater than certain threshold values associated with each individual sensor in the bank of sensors 91. Thus, based on the number of sensors blocked as the mailpiece 11 is transported past the sensor bank 91, the microprocessor 69 determines the first threshold value at which the height of the mailpiece 11 is not greater than. Microprocessor 69 then energizes the requisite number of printheads 78, 79, 80 to print cancellation marks on the mailpiece 11 that would be required to cover the number of rows of stamps typically associated with a mailpiece of that height. To even more precisely determine the overall size of the mailpiece, the same sensor bank can be used to identify to microprocessor 69 the trail and lead edges of the mailpiece 11 such that microprocessor 69 can calculate the length of the mailpiece 11 based on the transport velocity. Alternatively, the sensor bank 93 can be positioned to be associated with the arm 39 such that sensed rotation of arm 39 is translated by microprocessor 69 into a thickness of the mailpiece passing by the roller 35

In addition to the above, another sensor bank 93 can be utilized to determine the thickness of each individual mailpiece being processed through the singulating apparatus 15. That is, reverse belt assembly 25 is forced to rotate a variable amount around shaft 29 in the clockwise direction of FIG. 1 depending on the thickness of the mailpiece ingested in the singulating apparatus 15. A finger 95 extending from reverse belt assembly 25 will block certain ones of the sensor bank 93 depending on the amount of rotation of reverse belt assembly 25. This information is sent to microprocessor 69 such that the rotational movement of reverse belt assembly 25 is translated into a thickness of the mailpiece in the singulating apparatus. This thickness information can be utilized in conjunction with the height and length information to determine the expected number of rows of stamps on each individual mailpiece.

Figure 3:
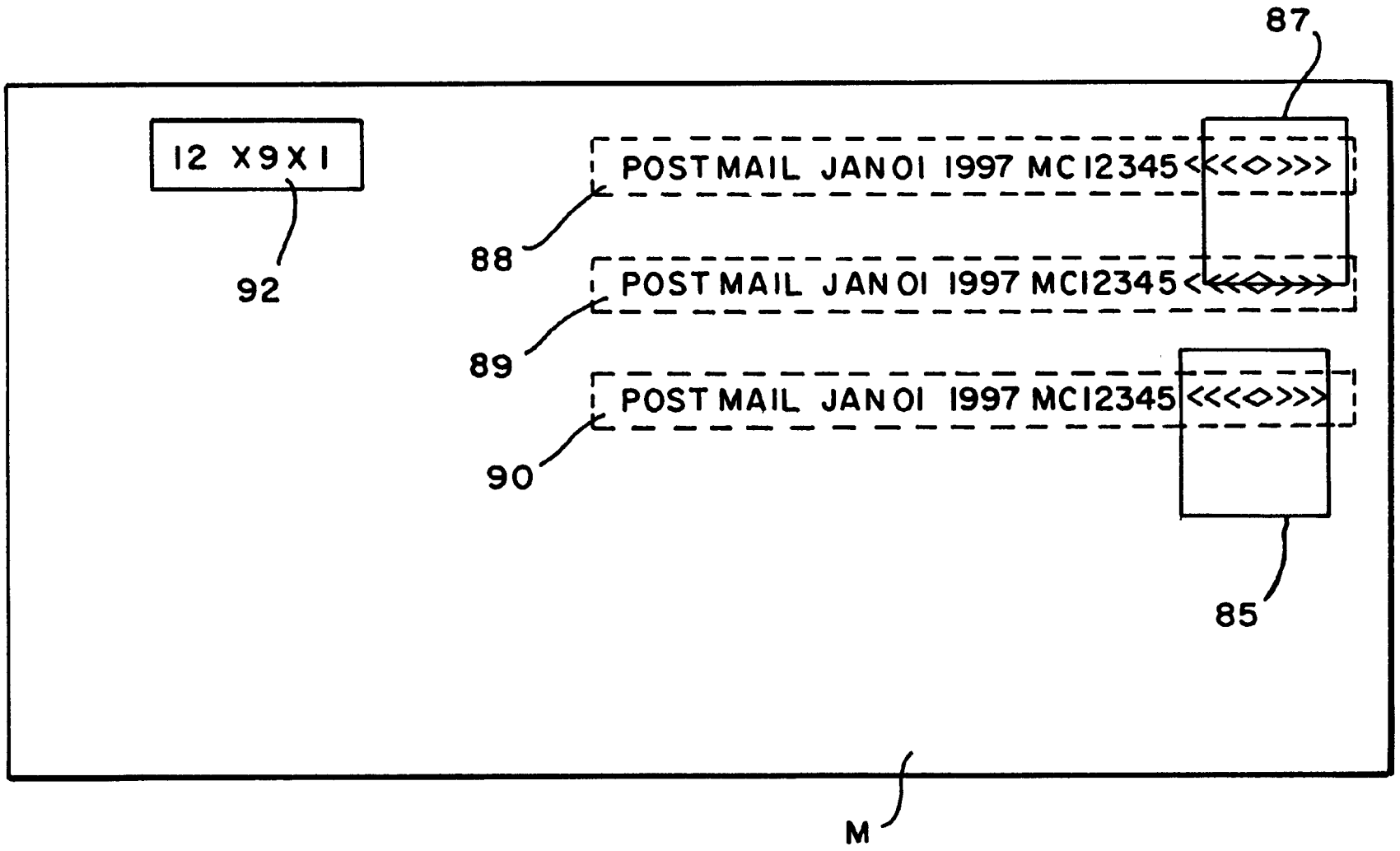
FIG. 3 is a mailpiece with a cancellation mark applied by the inventive cancellation machine of FIG. 1.

The use of the sensor banks 91/93 either alone or in combination to determine the number of rows of stamps on a mailpiece also permits microprocessor 69 to determine the amount of postage required for each mailpiece. In some countries, the postage required is based upon the size of the mailpiece instead of the weight. Accordingly, microprocessor 69 can have size rate charts stored in a memory associated therewith. This memory can be accessed to determine the amount of postage for each mailpiece. Furthermore, the size information can be printed next to the cancellation mark, as shown in FIG. 3, in human 92 and/or machine readable format (OCR, bar codes, etc.) for subsequent screening by the postal authority to determine if the proper postage has been applied to the mailpiece. Additionally, it is known to provide stamps or other items of value having technology (such as magnetic threads) incorporated therein which threads when magnetized are activated to provide a unique magnetic signature indicative of the value of the item. A corresponding magnetic read machine senses the magnetic signature and determines the value of the stamp or item. If this value detecting structure (or other similar value detecting structure) were incorporated in the cancellation machine of FIG. 1, the correct postage value could be calculated and the actual value of the applied stamps determined. In the event the actual value was sufficient, the stamps would be cancelled as previously discussed. However, if the actual value of the stamps was insufficient, the individual mailpiece would be routed for special handling as having insufficient postage applied. The conventional value detecting structure would only have to be positioned before the printing mechanism 63.

Figure 4:
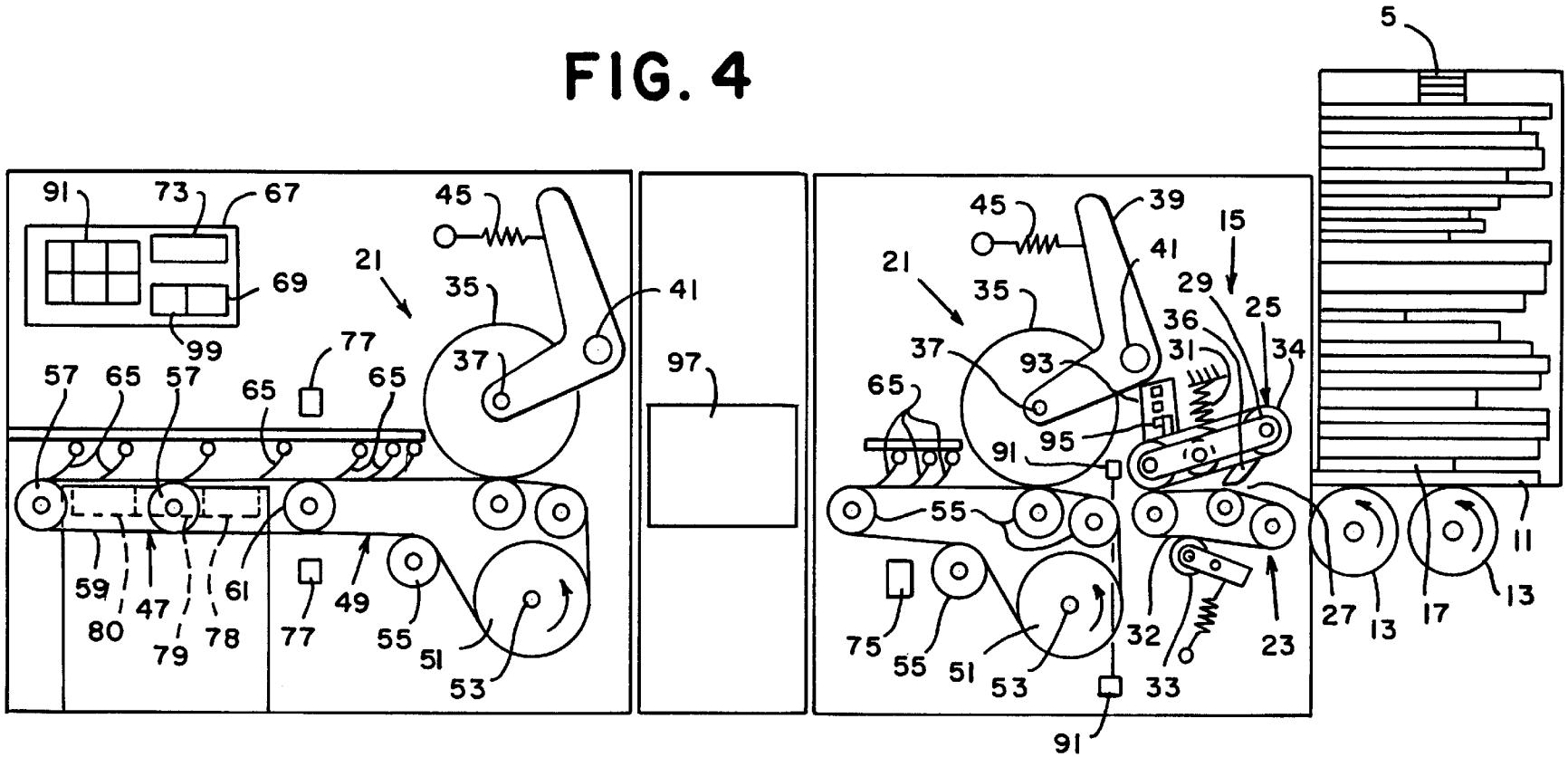
FIG. 4 is a second embodiment of a cancellation machine.
Figure 5:
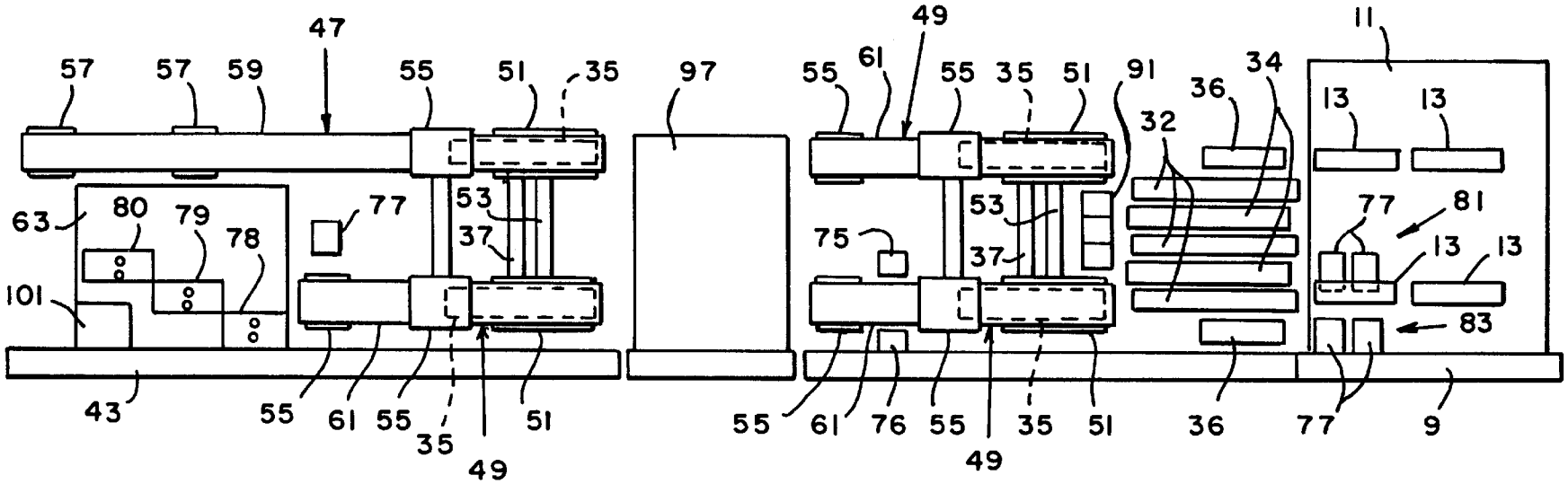
FIG. 5 is a side view of FIG. 4.

FIGS. 4 and 5 show another embodiment of the cancellation machine 1 which incorporates an in-line weighing apparatus 97 (shown schematically) as is conventionally used in mailing machines. For those countries where weight is determinative of the postage required, the in-line weighing structure is used to determine the weight of each mailpiece. The weight information is provided to microprocessor 69 which calculates the required postage and prints the weight on the mailpiece next to one of the cancellation marks in the same manner as the size dimensions discussed above. Moreover, if the value of the stamps can be detected, a real time determination of the sufficiency of the amount of the applied stamps as compared to the required postage can be determined as discussed above in connection with the structure for determining mailpiece size.

In yet another embodiment, the control panel 67 can have an accounting microprocessor 99 such that the combination of the accounting microprocessor 99, the microprocessor 69, and a printhead microprocessor 101 form a postage meter as described in U.S. Pat. No. 5,651,103 which is hereby incorporated by reference. By selecting a designated key of keyboard 71, the cancellation machine microprocessor 69 operates in the manner previously discussed to cancel postage stamps. However, upon the pressing of a different designated one of the keyboard keys, the microprocessor 69 goes into a postage meter mode where postage can be printed on each individual mailpiece by the printing mechanism 63. Moreover, since the apparatus can have size and/or weight determination capability as previously discussed, postage for each mailpiece can be automatically calculated and automatically printed on each mailpiece.

As described above, the inventive apparatus can include features which 1) permit processing of mixed mail, 2) cancel mailpieces having stamps thereon, 3) determine size and/or weight parameters of each mailpiece, 4) print such parameters on the mailpiece for subsequent audits and 5) calculate and apply postage to mixed mailpieces when not used as a canceling device.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims.

What is claimed is:

1. An apparatus for canceling postage on individual mailpieces of a stack of mixed mail, the apparatus comprising:

means for separating individual mailpieces from the stack of mixed mail;

means for feeding the separated individual mailpieces along a feed path;

means, positioned along the feed path, for detecting the presence of stamps on individual mailpieces;

a printing mechanism having a plurality of digital printheads;

control means, in communication with the detecting means, for operating the printing mechanism to print a cancellation mark over stamps on individual mailpieces in response to detection by the detecting means of the presence of stamps on individual mailpieces; and means for determining the number of rows of stamps on individual mailpieces and for selectively energizing only the individual ones of the plurality of digital printheads needed to ensure that the cancellation mark is printed over each of the sensed number of rows of stamps on individual mailpieces.

2. An apparatus as recited in claim 1, wherein the determining means includes a plurality of detecting means, each of the plurality of detecting means detecting a specific one of the number of rows of stamps on individual mailpieces.

3. An apparatus as recited in claim 1, wherein the determining means includes means for identifying the height of individual mailpieces and for associating a specific number of rows of stamps on individual mailpieces based on the identified height.

4. An apparatus as recited in claim 3, wherein the identifying means includes a bank of through-beam sensors positioned along the feed path, and wherein as the individual mailpieces are fed past the sensor bank the identifying means determines the height of the individual mailpieces based on the number of sensors tripped by the individual mailpieces.

5. An apparatus as recited in claim 3, further comprising means for measuring the thickness of individual mailpieces being fed along the feed path.

6. An apparatus as recited in claim 5, wherein the control means is in communication with the determining means and the measuring means and the control means operates the printing mechanism to print on the individual mailpieces together with the cancellation mark at least one size dimension of the individual mailpieces.

7. An apparatus as recited in claim 6 wherein the identifying means also identifies the length of the mailpiece and determines a required postage based on at least one of the height, length, and thickness of individual mailpieces.

8. An apparatus as recited in claim 7, further comprising means for switching the apparatus from a canceling mode to a postage mode, wherein at times when the apparatus is in the postage mode the control means does not print the cancellation mark on individual mailpieces but prints a postage indicium indicative of the required postage.

9. An apparatus as recited in claim 7, further comprising means for reading a total value of stamps on individual mailpieces, and wherein the control means is in communication with the reading means such that the control means compares the required postage to the total value and identifies individual mailpieces having the total value which is not at least equal to the required postage.

10. An apparatus as recited in claim 1, further comprising means for measuring a physical feature of individual mailpieces being fed along the feed path and for calculating a required postage value based on the physical feature.

11. An apparatus as recited in claim 10, wherein the measuring means is a scale and the physical feature is a weight of individual mailpieces.

12. A method for canceling postage on individual mailpieces of a stack of mixed mail, the method comprising:

separating individual mailpieces from the stack of mixed mail;

feeding the separated individual mailpieces along a feed path;

detecting the presence of stamps on individual mailpieces being fed along the feed path;

printing, using a plurality of printheads, a cancellation mark over stamps on individual mailpieces in response to detecting the presence of stamps on individual mail pieces;

determining the number of rows of stamps on individual mailpieces; and selectively energizing only the individual ones of the plurality of printheads needed to ensure that the cancellation mark is printed over each of the sensed number of rows of stamps on individual mailpieces.

13. An apparatus for canceling postage on individual mailpieces of a stack of mixed mail, the apparatus comprising:

means for separating individual mailpieces from the stack of mixed mail;

means for feeding the separated individual mailpieces along a feed path;

means, positioned along the feed path, for detecting the presence of stamps on individual mailpieces;

a printing mechanism;

control means, in communication with the detecting means, for operating the printing mechanism to print a cancellation mark over stamps on individual mailpieces in response to detection by the detecting means of the presence of stamps on individual mailpieces; and means for identifying the height of individual mailpieces and for associating a specific number of rows of stamps on individual mailpieces based on the identified height.

* * * * *